US007070400B2

(12) United States Patent
Greter

(10) Patent No.: US 7,070,400 B2
(45) Date of Patent: Jul. 4, 2006

(54) DIAPHRAGM PUMP WITH ELIMINATED PUMP CHAMBER DEAD SPACE, AND CIRCULAR RECESSES ON THE REVERSE SIDE OF THE DIAPHRAGM FOR IMPROVED DIAPHRAGM CHAMBER WALL ADHERENCE

(75) Inventor: Andy Greter, Steinhausen (CH)

(73) Assignee: Medela AG, Baar (CH)

( * ) Notice: Subject to any disclaimer, the term of this patent is extended or adjusted under 35 U.S.C. 154(b) by 0 days.

(21) Appl. No.: 10/250,470

(22) PCT Filed: Dec. 20, 2001

(86) PCT No.: PCT/CH01/00733

§ 371 (c)(1),
(2), (4) Date: Nov. 14, 2003

(87) PCT Pub. No.: WO02/053914

PCT Pub. Date: Jul. 11, 2002

(65) Prior Publication Data

US 2004/0071572 A1 Apr. 15, 2004

(30) Foreign Application Priority Data

Jan. 2, 2001 (EP) ..... 01100206

(51) Int. Cl.
*F04B 17/03* (2006.01)

(52) U.S. Cl. ..... 417/413.1; 417/415; 417/472; 92/98 R

(58) Field of Classification Search ..... 92/98 R; 417/413.1, 415, 472
See application file for complete search history.

(56) References Cited

U.S. PATENT DOCUMENTS

| | | | | | |
|---|---|---|---|---|---|
| 3,776,666 | A | * | 12/1973 | Ludwig | 417/411 |
| 4,086,036 | A | * | 4/1978 | Hagen et al. | 417/413.1 |
| 4,231,287 | A | | 11/1980 | Smiley | 92/94 |
| 4,571,160 | A | * | 2/1986 | King et al. | 417/437 |
| 4,737,083 | A | * | 4/1988 | Meyer | 417/413.1 |
| 4,993,925 | A | * | 2/1991 | Becker et al. | 417/413.1 |
| 5,141,409 | A | * | 8/1992 | Hirosawa et al. | 417/413.1 |
| 5,145,336 | A | * | 9/1992 | Becker et al. | 417/413.1 |
| 5,275,541 | A | * | 1/1994 | Becker et al. | 417/413.1 |
| 5,554,014 | A | * | 9/1996 | Becker | 417/413.1 |
| 5,676,531 | A | * | 10/1997 | Muscarella et al. | 417/413.1 |
| 5,690,017 | A | * | 11/1997 | Riedlinger | 92/100 |
| 5,699,717 | A | | 12/1997 | Riedlinger | 92/98 R |
| 5,776,098 | A | | 7/1998 | Silver et al. | 604/74 |

FOREIGN PATENT DOCUMENTS

| | | | |
|---|---|---|---|
| DE | 40 26 670 A1 | | 8/1990 |
| DE | G 94 10 116.7 | | 6/1994 |
| DE | G 94 10 116.7 | * | 11/1994 |
| DE | 295 14 009 U1 | | 8/1995 |

* cited by examiner

*Primary Examiner*—Charles G. Freay
*Assistant Examiner*—Emmanuel Sayoc
(74) *Attorney, Agent, or Firm*—Baniak, Pine and Gannon

(57) ABSTRACT

The diaphragm suction pump has a pump chamber (7) located in a base plate (6), the wall of said chamber extending in a conical manner from a central flat base section (7') to the lateral edge (8). The elastic pump diaphragm (5), which spans the pump chamber (7), is configured in such a way that it lies tightly against the entire pump chamber wall at the top dead center point of the drive connecting rod (4). The diaphragm (5) consists of a self-supporting elastic material with rear recesses (9; 10), which form hinges that can be elastically pretensioned during the operation of the diaphragm (5).

10 Claims, 2 Drawing Sheets

Figure 1:
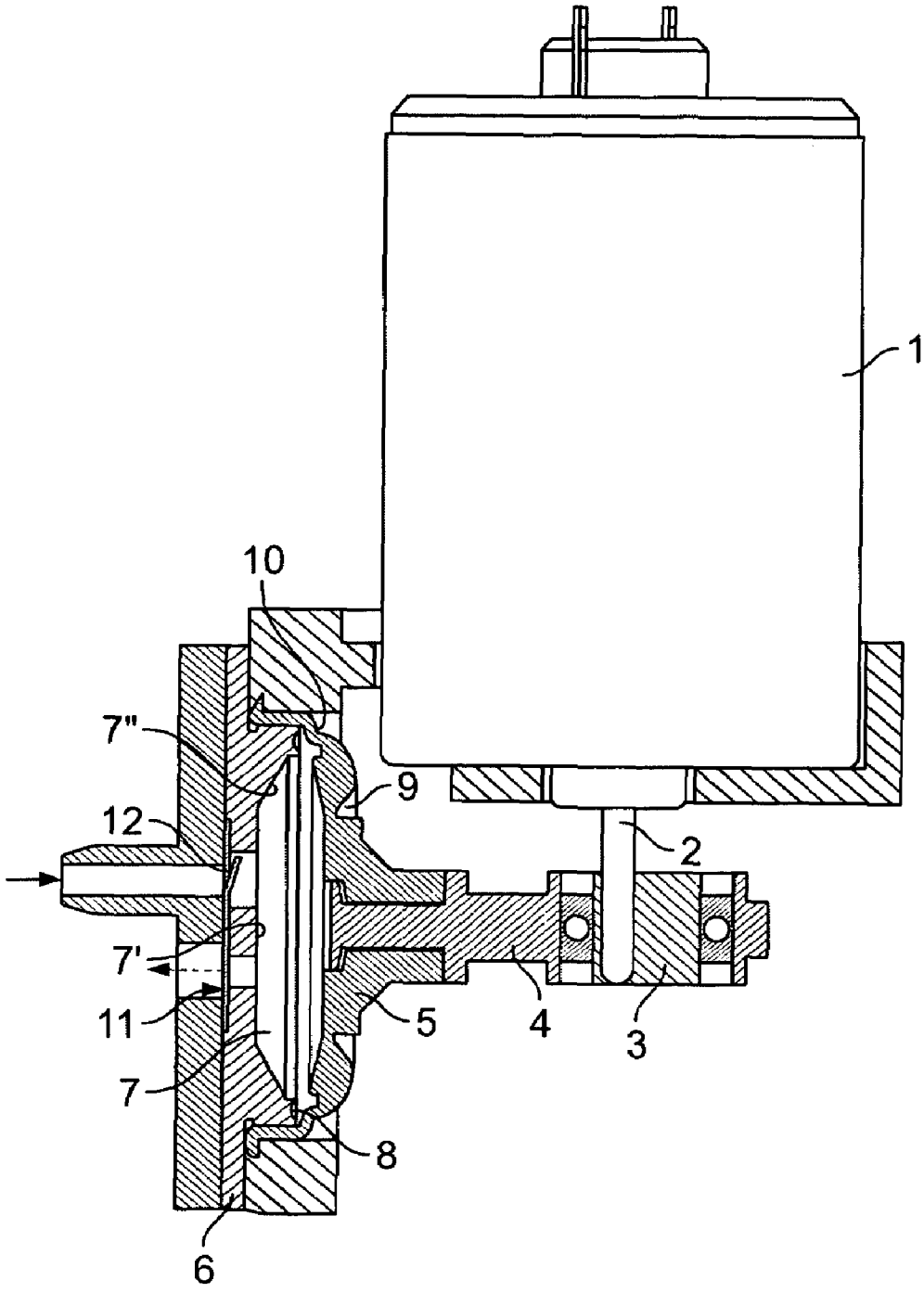

DIAPHRAGM PUMP WITH ELIMINATED PUMP CHAMBER DEAD SPACE, AND CIRCULAR RECESSES ON THE REVERSE SIDE OF THE DIAPHRAGM FOR IMPROVED DIAPHRAGM CHAMBER WALL ADHERENCE

The present invention relates to a diaphragm pump as suction pump, in particular for generating a vacuum, with an elastic pump diaphragm which is driven by a motor via a crank mechanism by means of a connecting rod and which spans a pump chamber provided in a base plate.

Diaphragm pumps of this type are known for a very wide variety of applications. Since today's diaphragm pumps have to manage with relatively large dead spaces in the pump chamber, high-performance diaphragm pumps are not able to be reduced any further in their dimensions.

An object of the present invention is to make available a diaphragm pump of the type defined at the outset which can provide maximum performance even with very small dimensions. A high-performance diaphragm pump of this type with reduced dimensions compared to the prior art can therefore be built into devices for which there are increasing demands for miniaturization. It has now been found surprisingly that this object can be achieved according to the invention, in a diaphragm pump of the type defined at the outset, by the features of the characterizing part of claim 1.

By virtue of the special design of the diaphragm, a dead space at the top dead center (TDC), i.e. upon ejection, can be achieved which is practically zero. This was not possible with previous diaphragm pumps.

Particular embodiments of the subject of the invention are defined in the dependent claims. These show that, with expedient arrangement of the pump valves in the base plate, practically no dead space remains.

Since the diaphragm at the top dead center of the connecting rod bears tightly against the pump chamber wall and therefore no dead space remains there, and in addition the dead spaces up to the actual valves can be kept very small, the pump performs its work immediately upon the working stroke, i.e. as soon as the ram moves together with the diaphragm away from the top dead center.

Figure 2:
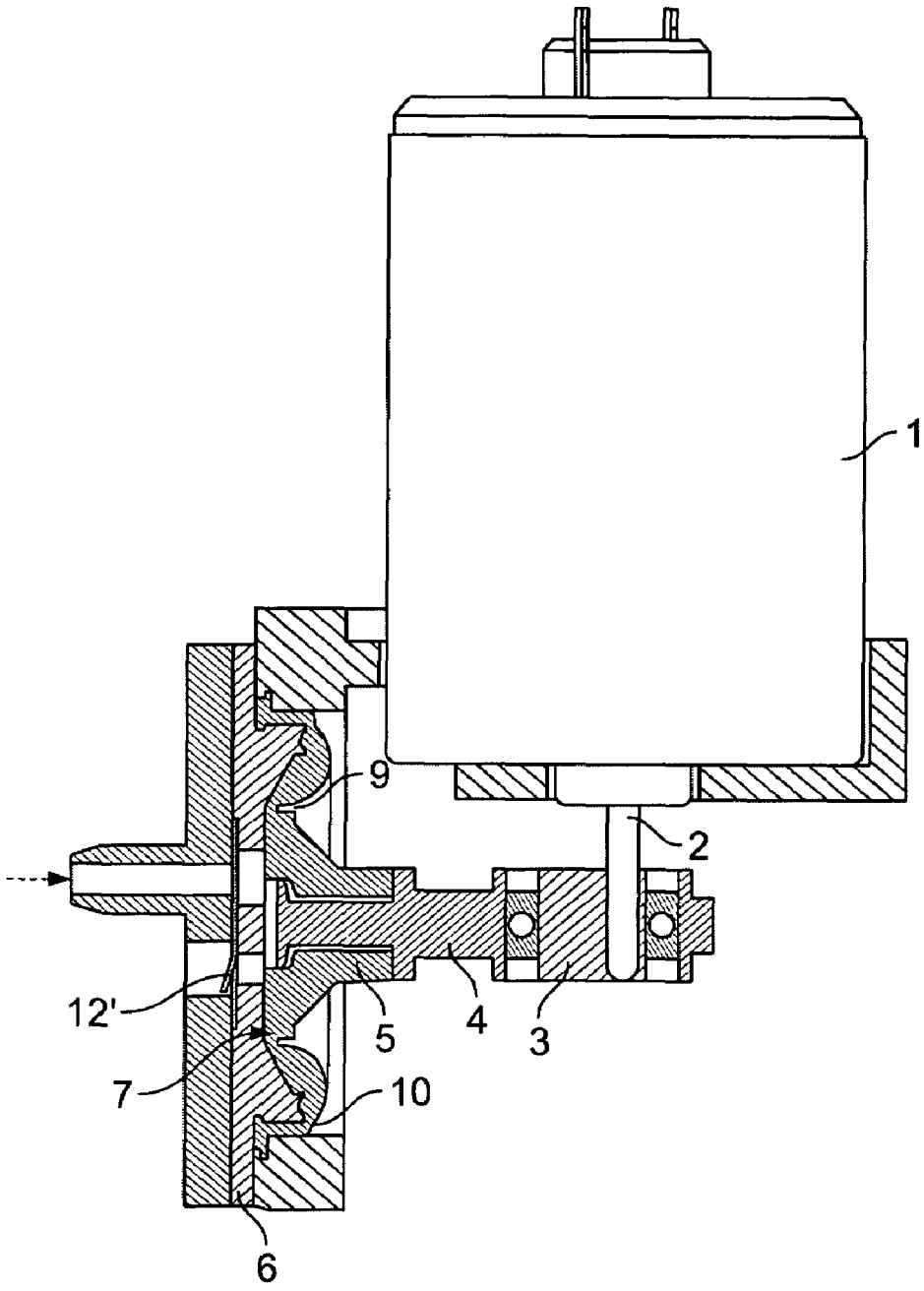

The invention is explained in greater detail below on the basis of an illustrative embodiment shown in the drawing, in which:

FIG. 1 shows a diaphragm pump according to the invention in cross section, with the diaphragm at the bottom dead center, i.e. at the end of the suction stroke, and FIG. 2 shows a corresponding view with the connecting rod and the diaphragm at the top dead center, i.e. at the end of the ejection stroke.

The drawing shows, purely diagrammatically, a diaphragm pump as a suction pump, in which an electric motor 1 drives a connecting rod 4 via a crank mechanism 2, 3, with a pump diaphragm 5 which is arranged at the end of the connecting rod 4 and which spans a pump chamber 7 provided in a base plate 6. The dish-shaped pump chamber 7 has a central base section 7' and turn [sic] 7" which widen conically from the latter and extend as far as the side edge 8. The diaphragm itself is made of elastic material, for example silicone, with a hardness of ca. 80 Shore and is relatively thick compared to conventional diaphragms.

The diaphragm 5 has, on its rear face, a circularly extending recess 9, and also an additional concentric groove 10, said groove 9 lying approximately in the area over the transition between the flat base section 7' of the pump chamber and the wall section 7" widening conically therefrom. The second groove 10 on the rear face lies in the area over the side edge 8 of the pump chamber 7.

The position of the diaphragm shown in FIG. 1, at the bottom dead center, corresponds to the position in which the inherently stiff elastic membrane is in the rest position. Upon movement of the ram 4 in the direction of the top dead center, the diaphragm deforms into the recesses 9, 10 in order to bear tightly against the wall of the pump chamber 7 (when the top dead center is reached). In the process, the elastic material is pretensioned, the recesses 9 and 10 forming kinds of hinges.

As can be seen from FIG. 2, this design permits tight bearing of the diaphragm against the wall of the pump chamber 7, so that practically no dead spaces remain in the pump chamber at the top dead center.

Upon the suction stroke, i.e. upon removal of the diaphragm from the top dead center, the vacuum is generated, and the movement here is assisted by the elastically pretensioned diaphragm 5, which reduces the energy consumption.

Since practically no dead spaces remain in the pump chamber and, in addition, the connection channels in the base plate to the valves are kept extremely short and are thus of small volume, the diaphragm pump works efficiently immediately after the start of the suction stroke.

The valves themselves are arranged in a very thin valve plate 12.

It will be seen from the drawing that the novel diaphragm pump can be kept extremely small, for example compared to the drive motor. It is therefore particularly suitable for use in miniaturized devices (e.g. battery-operated breast pumps).

FIG. 2 of the drawing shows the pump diaphragm 5 at the top dead center of the connecting rod 4, i.e. at the end of the ejection stroke. The diaphragm 5 here practically fills the entire pump chamber 7 (no dead space).

The hinge-like recesses 9, 10 are "compressed" in this position, so that the outer areas of the diaphragm are elastically pretensioned. By virtue of this pretensioning, the movement of the connecting rod 4 back to the bottom dead center is assisted (energy saving).

The invention claimed is:

1. A diaphragm pump, comprising an elastic pump diaphragm which is driven by a motor via a crank mechanism by means of a connecting rod and which spans a pump chamber provided in a base plate, wherein a pump chamber wall provided in the base plate extends in a conically widening manner from a central flat base section to a side edge thereof, and the diaphragm spanning the pump chamber is configured and arranged in such a way that it bears substantially tightly against the entire pump chamber wall and the side edge thereof, at a top dead center position of the connecting rod, with the result that there is substantially no remaining dead space at the top dead center position of the connecting rod, the diaphragm being made of substantially inherently stiff elastic material of predetermined thickness and configuration, and its deformation, with simultaneous pre-tensioning, for adaptation to the pump chamber wall and the side edge of the pump chamber upon the connecting rod's stroke in the direction of the top dead center position, being ensured by a single first circularly extending recess in a rear wall of the diaphragm, which forms a hinge that can be elastically pre-tensioned, and wherein the first circular recess is provided in the rear wall of the diaphragm in a transition area between the flat base section of the pump chamber and the conically widening pump chamber wall and wherein a single second circularly extending recess is provided in the rear wall of the diaphragm, which second recess is concentric to the first recess and in an area over the side edge of the pump chamber.

2. The diaphragm pump as claimed in claim 1, wherein inlet and outlet valves are provided in the central flat base section of the pump chamber, which valves are arranged on a rear face of the base plate in the area of the central flat base section so that minimal dead spaces remain between the valves and the pump chamber.

3. The diaphragm pump as claimed in claim 1, wherein the diaphragm is made of silicone rubber and has; a hardness of about 80 Shore.

4. The diaphragm pump as claimed in claim 2, wherein the valves are arranged in a valve plate.

5. A diaphragm pump, comprising an elastic pump diaphragm which is driven by a motor via a crank mechanism by means of a connecting rod and which spans a pump chamber provided in a base plate, wherein a pump chamber wall provided in the base plate extends in a conically widening manner from a central flat base section to a side edge thereof, and the diaphragm spanning the pump chamber is configured and arranged in such a way that it bears substantially tightly against the entire pump chamber wall, and the side edge thereof, at a top dead center position of the connecting rod, with the result that there is substantially no remaining dead space at the top dead center position of the connecting rod, the diaphragm being made of substantially inherently stiff elastic material of predetermined thickness and configuration, and its deformation, with simultaneous pre-tensioning, for adaptation to the pump chamber wall and the side edge of the pump chamber upon the connecting rod's stroke in the direction of the top dead center position, being ensured by at least one circularly extending first recess in a rear wall of the diaphragm, which recess forms a hinge that can be elastically pre-tensioned, wherein a further circularly extending recess is provided in the rear wall of the diaphragm, which further recess is concentric to the first recess in an area over the side edge of the pump chamber, and wherein a the single circular first recess is provided in the rear wall of the diaphragm lying in a transition area between the flat base section of the pump chamber and the conically widening pump chamber wall.

6. The diaphragm pump as claimed in claim 5, wherein inlet and outlet valves are provided in the central flat base section of the pump chamber, which valves are arranged on a rear face of the base plate in the area of said central flat base section so that minimal dead spaces remain between the valves and the pump chamber.

7. The diaphragm pump as claimed in claim 5, wherein the diaphragm is made of silicone rubber and has a hardness of about 80 Shore.

8. The diaphragm pump as claimed in claim 6, wherein the valves are arranged in a valve plate.

9. A diaphragm pump comprising an elastic pump diaphragm which is driven by a motor via a crank mechanism by means of a connecting rod and which spans a pump chamber provided in a base plate, wherein a pump chamber wall provided in the base plate extends in a conically widening manner from a central flat base section to a side edge thereof, and the diaphragm spanning the pump chamber is configured and arranged in such a way that it bears substantially tightly against the entire pump chamber wall and the side edge thereof, at the top dead center of the connecting rod, with the result that there is practically no remaining dead space at the top dead center position of the connecting rod, the diaphragm being made of substantially inherently stiff elastic material of predetermined thickness and configuration, and its deformation, with simultaneous pre-tensioning, for adaptation to the pump chamber wall and the side edge of the pump chamber upon the connecting rod's stroke in the direction of the top dead center position, being ensured by at least one first circularly extending recess in the rear wall of the diaphragm, which recess forms a hinge that can be elastically pretensioned, wherein the single circular first recess is provided in the rear wall of the diaphragm lying in a transition area between the flat base section of the pump chamber and the conically widening pump chamber wall and wherein a single further circularly extending recess is provided in the rear wall of the diaphragm, which further recess is concentric to the first recess and in an area over the side edge of the pump chamber, and wherein the first recess is compressed at the top dead center so that outer areas of the diaphragm are elastically pretensioned.

10. A diaphragm pump, comprising an elastic pump diaphragm which is driven by a motor via a crank mechanism by means of a connecting rod and which spans a pump chamber provided in a base plate, wherein the pump chamber wall provided in the base plate extends in a conically widening manner from a central flat base section to a side edge thereof, and the diaphragm spanning the pump chamber is configured and arranged in such a way that it bears substantially tightly against the entire pump chamber wall, and the side edge thereof, at a top dead center position of the connecting rod, with the result that there is substantially no remaining dead space at the top dead center of the connecting rod, the diaphragm being made of substantially inherently stiff elastic material of predetermined thickness and configuration, and its deformation, with simultaneous pre-tensioning, for adaptation to the pump chamber wall and the side edge of the pump chamber upon the connecting rod's stroke in the direction of the top dead center position, being ensured by at least one circularly extending recess in a rear wall of the diaphragm, which first recess forms a hinge that can be elastically pre-tensioned, and wherein the recess is a groove.

* * * * *